US010684573B2

(12) United States Patent
Kuroda et al.

(10) Patent No.: US 10,684,573 B2
(45) Date of Patent: Jun. 16, 2020

(54) IMAGE FORMING METHOD AND IMAGE FORMING APPARATUS

(71) Applicant: Oki Data Corporation, Minato-ku, Tokyo (JP)

(72) Inventors: Teruaki Kuroda, Tokyo (JP); Masahiro Kawano, Tokyo (JP); Yoshiaki Kusakabe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/446,807

(22) Filed: Jun. 20, 2019

(65) Prior Publication Data

US 2020/0033750 A1 Jan. 30, 2020

(30) Foreign Application Priority Data

Jul. 24, 2018 (JP) ..... 2018-138702

(51) Int. Cl.
*G03G 15/08* (2006.01)

(52) U.S. Cl.
CPC ..... *G03G 15/0806* (2013.01)

(58) Field of Classification Search
CPC ..... G03G 15/0818; G03G 15/0808; G03G 22/0634; G03G 15/065; C08F 220/34
USPC ..... 399/265
See application file for complete search history.

(56) References Cited

U.S. PATENT DOCUMENTS 5,119,138 A * 6/1992 Oda ..... G03G 21/0064 399/150

FOREIGN PATENT DOCUMENTS

JP 2018-017898 A 2/2018

* cited by examiner

*Primary Examiner* — Walter L Lindsay, Jr.
*Assistant Examiner* — Frederick Wenderoth
(74) *Attorney, Agent, or Firm* — Panitch Schwarze Belisario & Nadel LLP

(57) ABSTRACT

An image forming method includes: placing developer on a medium in accordance with image data to form a developer image; and fixing the developer image to the medium while conveying the medium along a conveying direction. The image forming method further includes: determining, as a blocked region, a region of the developer image where no developer is placed and whose upstream side in the conveying direction is blocked by a developer region where the developer is placed; and forming at least one groove extending in the conveying direction in an upstream region of the developer image that is located upstream of the blocked region in the conveying direction and included in the developer region.

12 Claims, 7 Drawing Sheets

FIG. 4
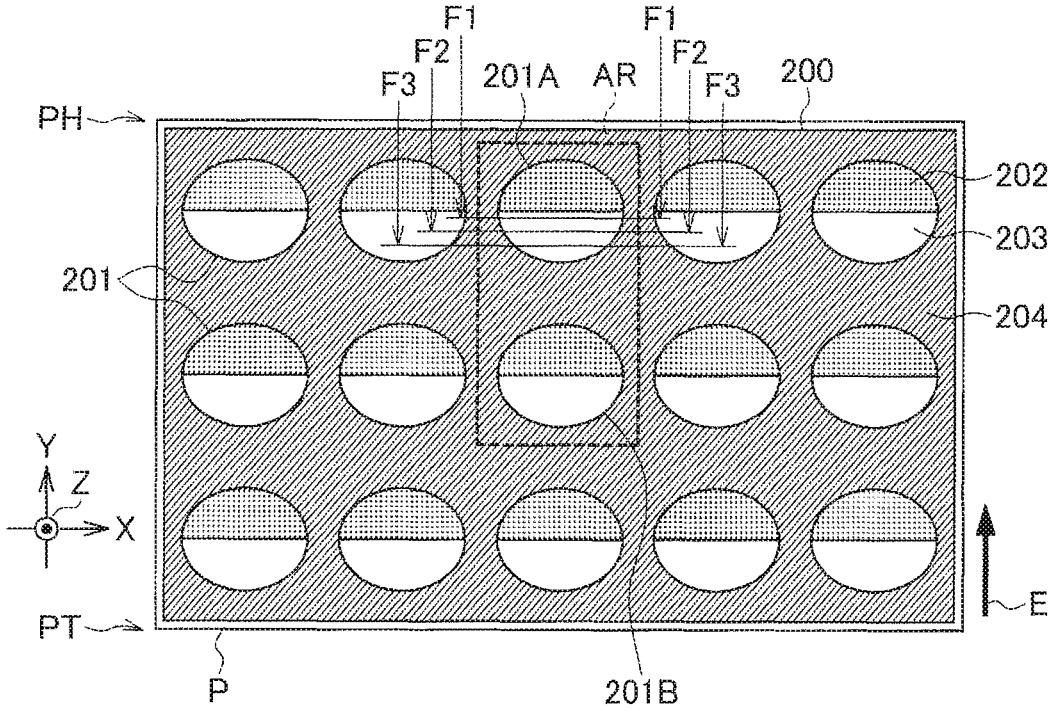
FIG. 5A F1-F1
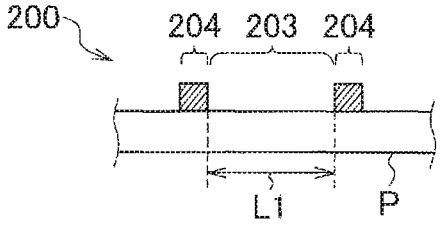
FIG. 5B F2-F2
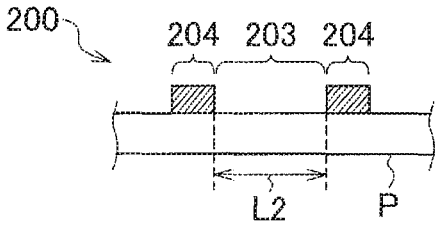
FIG. 5C F3-F3
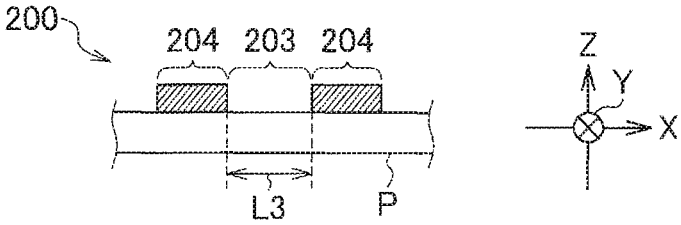

IMAGE FORMING METHOD AND IMAGE FORMING APPARATUS

CROSS-REFERENCE TO RELATED APPLICATION

This application claims priority under 35 U.S.C. § 119(b) to Japanese Patent Application No. 2018-138702, filed Jul. 24, 2018, the disclosure of which is incorporated herein by reference in its entirety.

BACKGROUND OF THE INVENTION

1. Field of the Invention

The present invention relates to an image forming method and an image forming apparatus, and is preferably applied to, for example, an electrophotographic image forming apparatus (or printer).

2. Description of the Related Art

As an example of conventional common image forming apparatuses, there is an image forming apparatus that conveys a paper sheet as a medium with a conveying unit, generates toner images in image drum units, transfers the toner images onto the sheet, applies heat and pressure to the sheet to fix the toner images to the sheet in a fixing unit, thereby forming or printing an image.

Recently, there are image forming apparatuses capable of forming images on various types of media, such as coated or gloss paper sheets with their printing surfaces processed, or transparent resin films, in addition to normal paper sheets (or plain paper sheets) (see, e.g., Japanese Patent Application Publication No. 2018-17898).

In some cases, an image forming apparatus prints, on a film as a medium, a medical image obtained by a medical device, such as a magnetic resonance imaging (MRI) device or a computed tomography (CT) scanner. For example, on the assumption that a doctor or other person observes the medical image while comparing it with other photographs or the like, the medical image may be printed on the medium, such as a film, in such a manner that the image is surrounded by a black background region, like existing medical photographs or the like.

When printing such an image and a background region, the image forming apparatus can represent the background region with uniformly dark black, by forming and transferring a sufficiently thick toner layer with a large amount of toner onto a background portion of the medium. In a particularly light portion of the image, the amount of toner is extremely small, and the image forming apparatus transfers little toner onto the medium.

The fixing unit of the image forming apparatus includes, for example, two rollers disposed with a conveying path of the medium therebetween, rotates one of the rollers, which is a heating roller, while heating the heating roller, and rotates the other of the rollers, which is a pressure roller, while pressing the pressure roller against the heating roller, thereby applying heat and pressure to the medium.

In particular, when the image forming apparatus prints an image and a black background region surrounding the image on a medium that is a film, air located in a portion of the image where the amount of toner is small is gradually pushed upstream by the two rollers of the fixing unit. The air is then blocked and gradually compressed by the background region, where the amount of toner is large, so that the pressure of the air is gradually increased.

When the pressure of the air is sufficiently increased, the air may escape upstream to a space between the toner forming the background region and the heating roller, i.e., a space on the surface of the toner. In this case, the fixing unit applies heat and pressure in a state where the two rollers sandwich the air in addition to the medium and toner. This results in a situation where in the image and background region fixed on the medium, fixing results, such as the shade or surface state, of the region where the air was located differ from those of its surroundings, and a mark is additionally formed on the original image or background region. As such, when the image forming apparatus prints an image and a background region surrounding the image on a medium such as a film, degradation in image quality can occur in the fixing unit.

SUMMARY OF THE INVENTION

An object of an aspect of the present invention is to provide an image forming method and an image forming apparatus capable of preventing degradation in image quality caused during a fixing process.

According to an aspect of the present invention, there is provided an image forming method including: placing developer on a medium in accordance with image data to form a developer image; and fixing the developer image to the medium while conveying the medium along a conveying direction. The image forming method further includes: determining, as a blocked region, a region of the developer image where no developer is placed and whose upstream side in the conveying direction is blocked by a developer region where the developer is placed; and forming at least one groove extending in the conveying direction in an upstream region of the developer image that is located upstream of the blocked region in the conveying direction and included in the developer region.

According to another aspect of the present invention, there is provided an image forming method including: placing developer on a medium in accordance with image data to form a developer image; and fixing the developer image to the medium while conveying the medium along a conveying direction. The image forming method further includes: determining, as a blocked region, a developer-poor region of the developer image whose upstream side in the conveying direction is blocked by a developer-rich region where an amount of developer per unit area is greater than that of the developer-poor region; and forming at least one groove extending in the conveying direction in an upstream region of the developer image that is located upstream of the blocked region in the conveying direction and included in the developer-rich region.

BRIEF DESCRIPTION OF THE DRAWINGS

In the attached drawings:

FIG. 4 is a schematic view illustrating a configuration of a print image;

FIGS. 5A, 5B, and 5C are schematic sectional views illustrating a thickness of a toner layer in the print image;

DETAILED DESCRIPTION OF THE INVENTION

Embodiments of the present invention will be described below with reference to the drawings.

<1. Configuration of Image Forming Apparatus>

Figure 1:
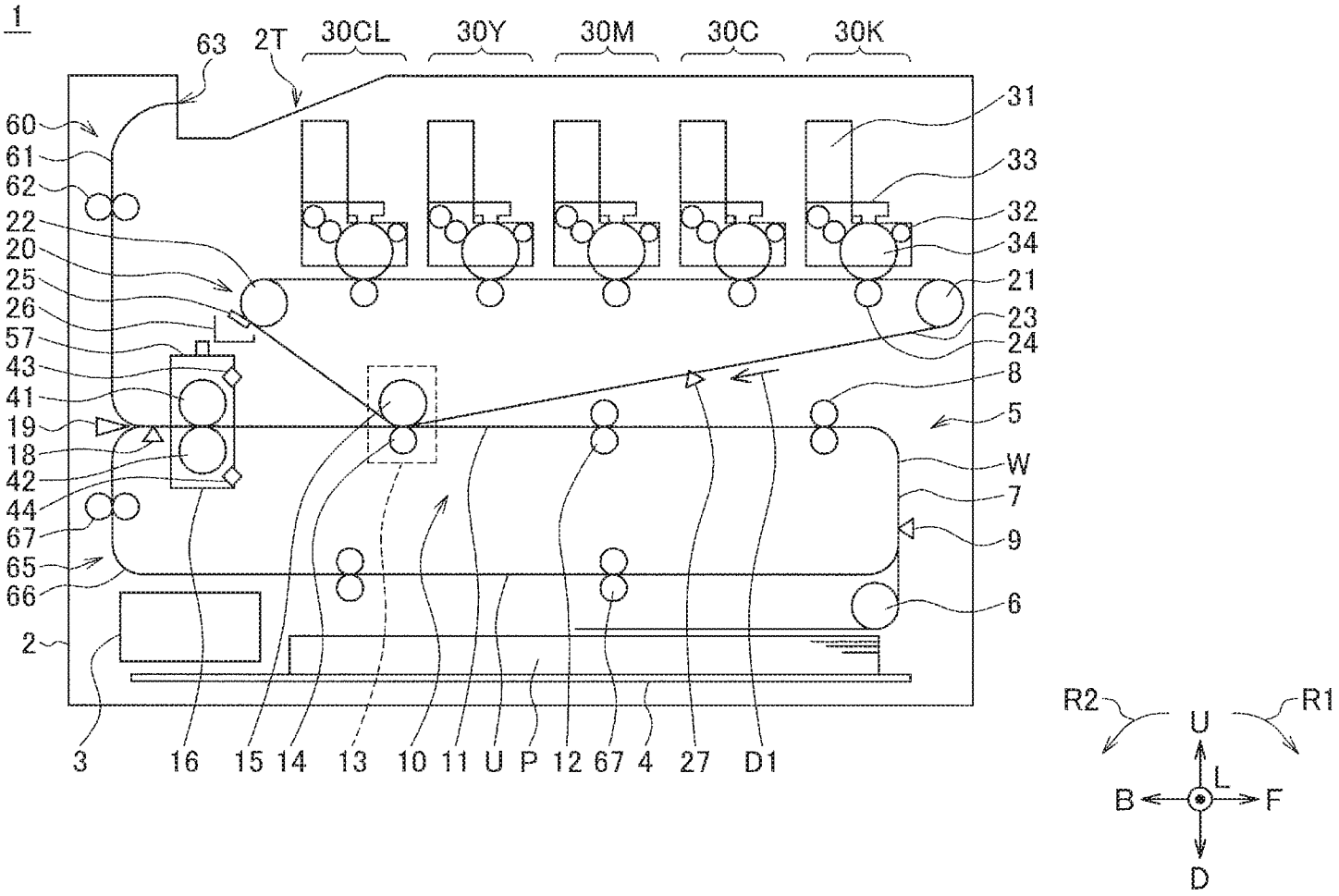
FIG. 1 is a schematic diagram illustrating a configuration of an image forming apparatus.

As illustrated in FIG. 1, an image forming apparatus 1 is an electrophotographic printer, and capable of forming (or printing) a color image on a sheet P as a medium. The image forming apparatus 1 is a single function printer (SFP) having a printer function but having neither an image scanner function of reading a document nor a communication function using telephone lines.

The image forming apparatus 1 includes a substantially box-shaped printer housing 2 in which various components are disposed. The following description assumes that the right end of the image forming apparatus 1 in FIG. 1 is a front side of the image forming apparatus 1, and an up-down direction, a left-right direction, and a front-rear direction are those as viewed toward the front side. In FIG. 1, the leftward, forward, rearward, upward, and downward directions are indicated by arrows L, F, B, U, and D, respectively.

The image forming apparatus 1 includes a controller 3 that entirely controls the image forming apparatus 1. The controller 3 may be implemented by processing circuitry, which may include a processor that executes a program stored in a memory to perform functions of the controller 3 or may be hardware circuitry. The controller 3 is connected wirelessly or by wire to a host apparatus, such as a computer apparatus, as described later. Upon receiving print data including image data to be printed and the like from the host apparatus, the controller 3 performs a printing process to form a printed image on a surface of a sheet P.

A sheet cassette 4 that stores sheets P is disposed at a lowermost portion of the printer housing 2. A sheet feeding unit 5 is disposed on the upper side of the front side of the sheet cassette 4. The sheet feeding unit 5 includes a hopping roller 6 disposed on the upper side of the front side of the sheet cassette 4, a conveyance guide 7 that guides a sheet P upward along a conveying path W, a pair of registration rollers 8 facing each other with the conveying path W therebetween, and the like.

The sheet feeding unit 5 picks up the sheets P stored in the sheet cassette 4 one by one by rotating the hopping roller 6 under control of the controller 3 as appropriate, causes the sheet P to advance upward along the conveying path W with the conveyance guide 7, and then causes the sheet P to turn rearward and abut the pair of registration rollers 8. The pair of registration rollers 8 are controlled to rotate as appropriate and apply frictional force to the sheet P, thereby correcting skew of the sheet P, which is a phenomenon in which side edges of the sheet P are slanted with respect to the traveling direction, to place the sheet P in a state where its leading and trailing edges are oriented in the left-right direction, and then feeding the sheet P rearward.

A middle conveyance unit 10 is disposed behind the pair of registration rollers 8. The middle conveyance unit 10 includes a conveyance guide 11 forming the conveying path W extending substantially along the front-rear direction. A pair of conveying rollers 12 and a secondary transfer unit 13 are disposed on the conveying path W. The pair of conveying rollers 12 rotate under control of the controller 3, thereby conveying the sheet P rearward at a predetermined timing. The secondary transfer unit 13 includes a secondary transfer roller 14 disposed below the conveying path W and a secondary transfer backup roller 15 disposed above the conveying path W to face the secondary transfer roller 14.

An intermediate transfer unit 20 is disposed above the middle conveyance unit 10. Above the intermediate transfer unit 20, five image drum units 30K, 30C, 30M, 30Y, and 30CL, which may be referred to as the image drum units 30, are sequentially arranged in the front-rear direction.

The intermediate transfer unit 20 includes a drive roller 21 disposed above and ahead of the secondary transfer backup roller 15, and a belt driven roller 22 disposed above and behind the secondary transfer backup roller 15. The intermediate transfer unit 20 also includes an intermediate transfer belt 23 stretched around the secondary transfer backup roller 15, drive roller 21, and belt driven roller 22. The intermediate transfer belt 23 is an endless belt formed using a plastic film having high resistance.

The intermediate transfer unit 20 further includes primary transfer rollers 24 disposed beneath a section of the intermediate transfer belt 23 stretched between the drive roller 21 and the belt driven roller 22, more specifically beneath the five image drum units 30. The primary transfer rollers 24 are arranged in the front-rear direction.

The intermediate transfer unit 20 rotates the drive roller 21 in the direction of arrow R1 with drive force supplied from a motor (not illustrated), thereby causing the intermediate transfer belt 23 to move in a direction along arrow D1. Each of the primary transfer rollers 24 rotates in the direction of arrow R1 with a predetermined voltage applied thereto.

The intermediate transfer unit 20 also includes a cleaning blade 25 disposed in contact with an outer peripheral surface of the intermediate transfer belt 23 below and behind the belt driven roller 22, and a cleaner container 26 disposed below the cleaning blade 25 to open upward. In addition, the intermediate transfer unit 20 includes a density sensor 27 disposed in the middle of a section of the intermediate transfer belt 23 stretched between the drive roller 21 and the secondary transfer backup roller 15.

The five image drum units 30K, 30C, 30M, 30Y, and 30CL form toner images with toners of five colors of black (K), cyan (C), magenta (M), yellow (Y), and clear (CL), respectively. Hereinafter, the image drum units 30 will also be referred to as ID units 30. The clear toner is colorless transparent toner, and is, for example, used to cover other color toners to provide gloss to the surface.

Each image drum unit 30 includes a toner cartridge 31, an image forming portion 32, and a light emitting diode (LED) head 33. The toner cartridge 31 stores toner as developer, and supplies the toner to the image forming portion 32. The LED head 33 includes multiple LEDs arranged linearly along the left-right direction, and causes the LEDs to sequentially emit light in a light emitting pattern in accordance with data supplied from the controller 3, which will be described later in detail.

The image forming portion 32 includes multiple rollers, a photosensitive drum 34, and the like, rotates them as appropriate while applying predetermined voltages to them as appropriate. Meanwhile, the LED head 33 illuminates a peripheral surface of the photosensitive drum 34 with light, thereby forming an electrostatic latent image. The image forming portion 32 then applies toner to the peripheral surface of the photosensitive drum 34 to form a toner image, and transfers the toner image onto the intermediate transfer belt 23 between the photosensitive drum 34 and the corresponding primary transfer roller 24.

Thus, the toner images of the different colors are sequentially transferred and superimposed onto the outer peripheral surface of the intermediate transfer belt 23. The intermediate transfer unit 20 continues to move the intermediate transfer belt 23, thereby conveying the toner images to the secondary transfer unit 13.

The secondary transfer unit 13 applies a predetermined voltage to the secondary transfer roller 14 and rotates the secondary transfer roller 14 in the direction of arrow R2 while applying a predetermined voltage to the secondary transfer backup roller 15 and rotating the secondary transfer backup roller 15 in the direction of arrow R1, thereby transferring the toner images from the intermediate transfer belt 23 onto the sheet P and conveying the sheet P rearward along the conveying path W.

A fixing unit 16 is disposed behind the secondary transfer unit 13. The fixing unit 16 includes a heating roller unit 41 disposed above the conveying path W, and a pressure roller 42 disposed in contact with the lower side of the heating roller unit 41. In the fixing unit 16, the heating roller unit 41 and pressure roller 42 face each other with the conveying path W therebetween. The fixing unit 16 also includes a heating roller unit temperature sensor 43 that detects a temperature of the heating roller unit 41, and a pressure roller temperature sensor 44 that detects a temperature of the pressure roller 42.

Figure 2:
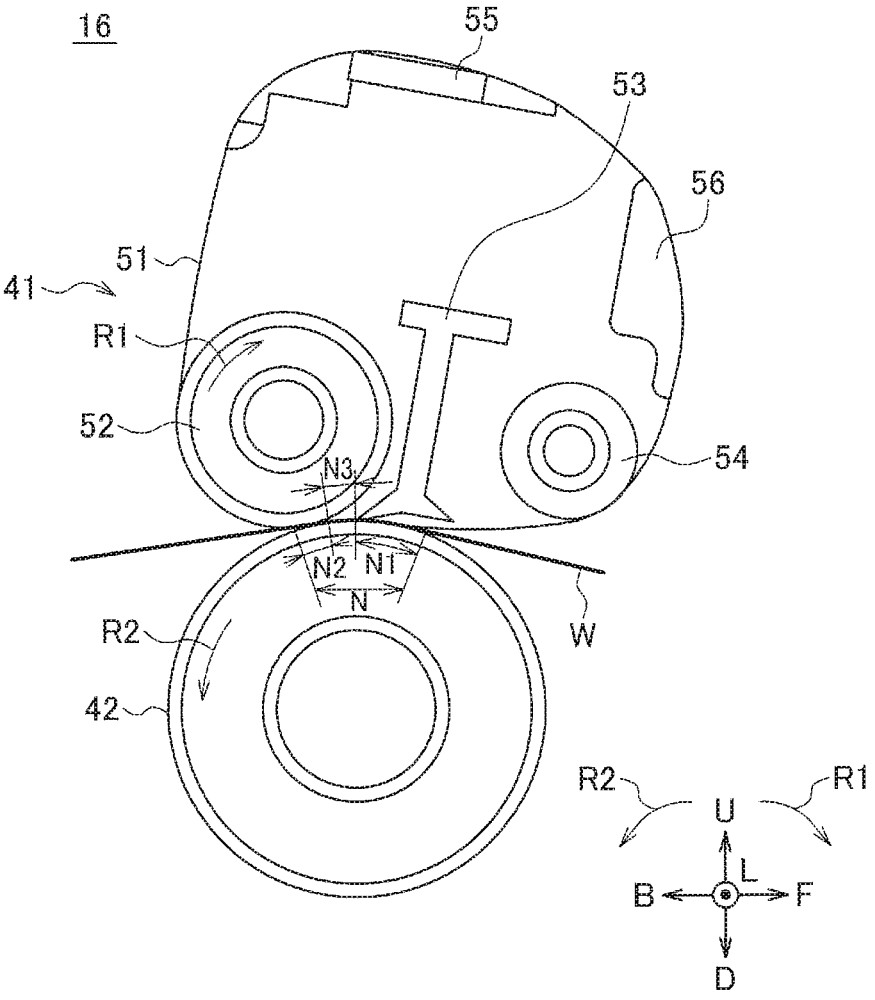
FIG. 2 is a schematic diagram illustrating a configuration of a fixing unit.

As illustrated in FIG. 2, the heating roller unit 41 of the fixing unit 16 includes a fixing belt 51, and also includes a fixing roller 52, a fixing pad 53, a guide roller 54, a heater 55, a belt guide 56, and the like, which are disposed inside the fixing belt 51.

The fixing belt 51 is an endless belt made of resin or the like having heat resistance. While the fixing belt 51 has, in its natural state, a cylindrical shape having a central axis along the left-right direction, it is flexible and deforms in conformity with parts or the like abutting the fixing belt 51.

The fixing roller 52 is disposed on the rear lower side in the fixing belt 51. The fixing roller 52 has an elongated cylindrical shape having a central axis along the left-right direction, and is rotatably supported by a chassis 57 (see FIG. 1) of the fixing unit 16. Lower and rear portions of a peripheral surface of the fixing roller 52 abut a rear lower portion of an inner peripheral surface of the fixing belt 51. The fixing roller 52 is rotated in the direction of arrow R1 (clockwise in FIG. 2) by drive force supplied from a fixing motor (not illustrated).

The fixing pad 53 is disposed in front of the fixing roller 52, and roughly has a rectangular parallelepiped shape that is sufficiently long in the left-right direction, somewhat long in the up-down direction, and short in the front-rear direction. When viewed in the left-right direction, a wedge shaped projection is formed on each of the front and rear sides of a lower end of the fixing pad 53.

The fixing pad 53 is urged obliquely downward and rearward (specifically, in a direction slightly inclined rearward from the downward direction) by an urging member (not illustrated), such as a spring. Thus, the lower end of the fixing pad 53 abuts the inner peripheral surface of the fixing belt 51 near a center of a lower portion of the inner peripheral surface. A small gap is formed between a rear end of a lower end portion of the fixing pad 53 and a portion of a lower portion of the fixing roller 52 that abuts the inner peripheral surface of the fixing belt 51.

The guide roller 54 is disposed in front of the fixing pad 53, and has an elongated cylindrical shape having a central axis along the left-right direction. The guide roller 54 has substantially the same length as the fixing roller 52 in the left-right direction, and has a smaller diameter than the fixing roller 52. The guide roller 54 is rotatably supported by the chassis 57 of the fixing unit 16. Front and lower portions of a peripheral surface of the guide roller 54 abut a front lower portion of the inner peripheral surface of the fixing belt 51.

The heater 55 has a plate shape that is long in the left-right direction, short in the front-rear direction, and thin in the up-down direction. The heater 55 abuts the fixing belt 51 near an upper end of the inner peripheral surface of the fixing belt 51, or on the upper side of the fixing pad 53 and the like. For example, the heater 55 includes a thin plate-shaped metal plate with a surface on which a predetermined wiring pattern, a heating resistive element, or the like is arranged, and when the heater 55 is supplied with current from a predetermined power circuit, the heater 55 passes the current through the heating resistive element to produce heat, and transfers the heat to the fixing belt 51, thereby heating the fixing belt 51. A heater support is disposed around the heater 55 to position the heater 55 relative to the chassis 57 of the fixing unit 16 and support a portion of the fixing belt 51. The belt guide 56 abuts the inner peripheral surface of the fixing belt 51 at and near a front end of the inner peripheral surface, and guides the fixing belt 51 so that the fixing belt 51 runs while maintaining the general shape of the fixing belt 51.

The pressure roller 42 of the fixing unit 16 has an elongated cylindrical shape having a central axis along the left-right direction, and rotatably supported by the chassis 57 of the fixing unit 16 through bearings (not illustrated). The diameter of the pressure roller 42 is larger than that of the fixing roller 52, and is somewhat smaller than an apparent diameter of the fixing belt 51.

The pressure roller 42 is urged in a substantially upward direction by an urging member (not illustrated), such as a spring. Thus, a portion of the pressure roller 42 near its upper end is pressed against an outer peripheral surface of the fixing belt 51, causing the inner peripheral surface of the fixing belt 51 to abut a portion of the fixing roller 52 near its lower end and a rear portion of the lower end of the fixing pad 53. Thus, in the fixing unit 16, the pressure roller 42 is pressed against the fixing roller 52 and fixing pad 53 through the fixing belt 51.

For convenience of description, hereinafter, the area where the pressure roller 42 is pressed against the fixing pad 53 will be referred to as the first nip portion N1, the area where the pressure roller 42 is pressed against the fixing roller 52 will be referred to as the second nip portion N2. The second nip portion N2 is formed behind the first nip portion N1 and slightly separated from the first nip portion N1. Hereinafter, the area between the first nip portion N1 and the second nip portion N2 will be referred to as the third nip portion N3. The first nip portion N1, second nip portion N2, and third nip portion N3 will be referred to collectively as the nip portion N.

With this configuration, when the sheet P is conveyed along the conveying path W from the upstream side (or front side) to the fixing unit 16, the fixing unit 16 can nip the sheet P in the nip portion N between the heating roller unit 41 and the pressure roller 42, and apply heat and pressure to the sheet P, in particular in the first nip portion N1 and second nip portion N2.

A switch blade 19 is disposed behind the fixing unit 16 (see FIG. 1). The switch blade 19 switches a conveying route of the sheet P between an upper route and a lower route, under control of the controller 3. A discharge unit 60 is disposed above the switch blade 19. The discharge unit 60 includes a conveyance guide 61 that guides the sheet P upward along the conveying path W, a pair of conveying rollers 62 facing each other with the conveying path W therebetween, and the like.

A reconveying unit 65 is disposed below the switch blade 19, fixing unit 16, and middle conveyance unit 10. The reconveying unit 65 includes a conveyance guide 66 forming a reconveying path U, pairs of conveying rollers 67, and the like. The reconveying path U extends downward from the lower side of the switch blade 19, then extends forward, and then joins the conveying path W in the sheet feeding unit 5.

When discharging the sheet P, the controller 3 controls the switch blade 19 to switch the conveying route of the sheet P to the upper route on the discharge unit 60 side. The discharge unit 60 conveys upward the sheet P received from the switch blade 19 and discharges the sheet P onto the discharge tray 2T through an outlet 63. When returning the sheet P to the sheet feeding unit 5, the controller 3 controls the switch blade 19 to switch the conveying route of the sheet P to the lower route on the reconveying unit 65 side. The reconveying unit 65 conveys the sheet P received from the switch blade 19 through the reconveying path U to the sheet feeding unit 5, causing the sheet P to be conveyed again along the conveying path W.

<2. Block Configuration of Image Forming Apparatus>

Figure 3:
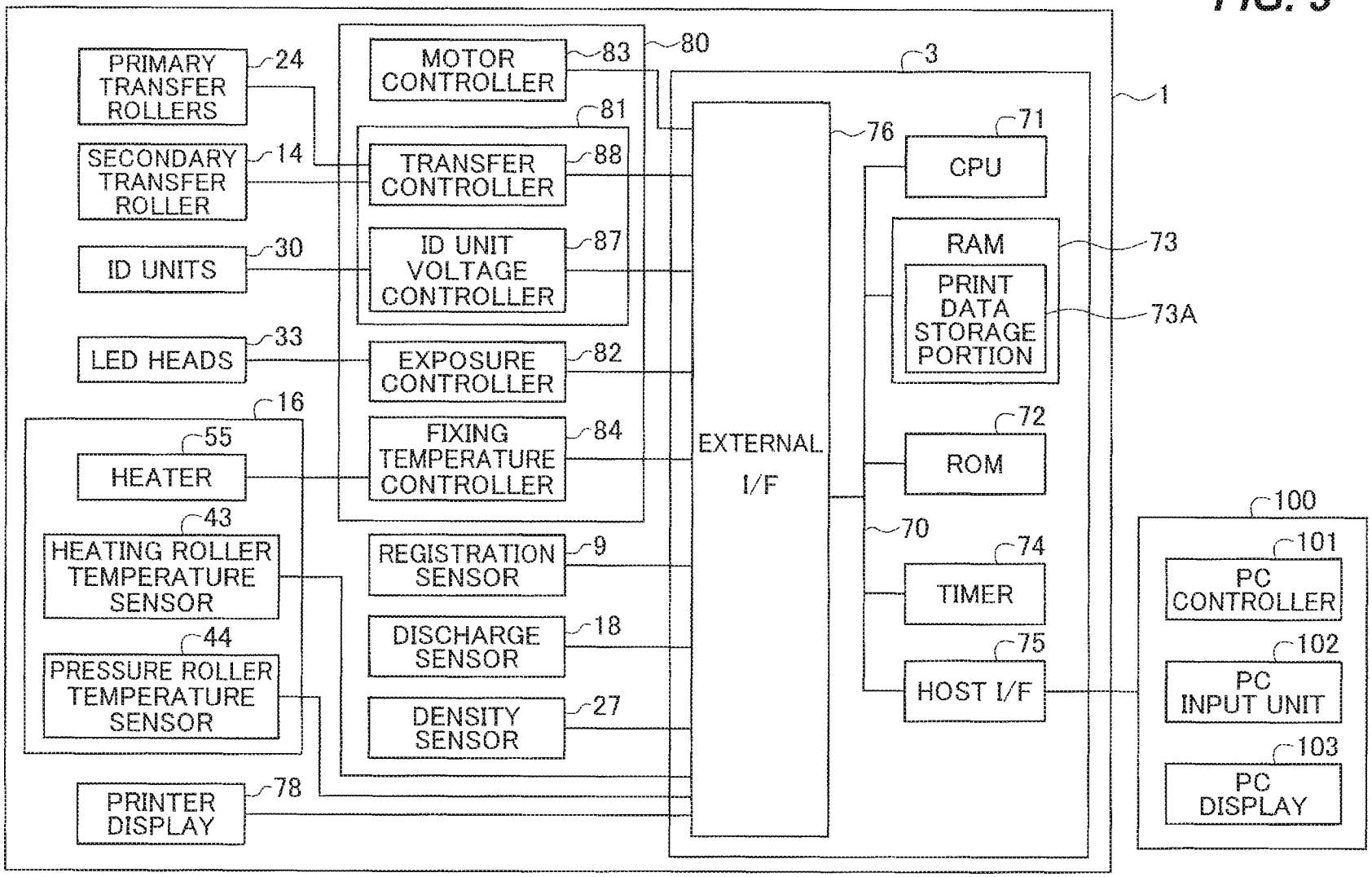
FIG. 3 is a schematic diagram illustrating a block configuration of the image forming apparatus.

A block configuration of the image forming apparatus 1 will now be described with reference to FIG. 3 together with a computer apparatus 100 that is a host apparatus connected to the image forming apparatus 1.

The computer apparatus 100 is configured similarly to common personal computers (PCs), and includes a PC controller 101, a PC input unit 102, and a PC display 103. The PC controller 101 includes a central processing unit (CPU), a read only memory (ROM), a random access memory (RAM), and the like, which are not illustrated, and also includes a storage unit including a hard disk drive, flash memory, or the like. The PC controller 101 reads programs stored in the ROM or storage unit and performs arithmetic processing in accordance with the programs in the CPU while using the RAM as a work area, thereby performing various processes in accordance with the programs. The storage unit of the PC controller 101 stores various data, such as an image (or image data), in addition to the various programs.

The PC input unit 102 includes a keyboard, a mouse, and the like, and receives operational input from a user, and outputs it to the PC controller 101. The PC display 103 is a display including, for example, a liquid crystal panel, and displays a screen based on a display instruction supplied from the PC controller 101.

When the PC controller 101 of the computer apparatus 100 receives an operational input from the user through the PC input unit 102, it reads and executes an application program for, e.g., image processing, and displays an image subjected to a predetermined image processing, on the PC display 103. Also, when the PC controller 101 receives a print command from the user through the PC input unit 102, it generates print data such that multiple images are arranged in a single sheet, and transmits the print data to the image forming apparatus 1.

The print data includes print settings required when a printing process is performed on a sheet. The print settings include, for example, settings indicating the orientation of the sheet (portrait or landscape), the print density, whether to perform color or monochrome printing, and the thickness or type of the sheet (plain paper, heavy paper, OHP sheet, or the like).

The controller 3 of the image forming apparatus 1 includes a CPU 71, a ROM 72, a RAM 73, a timer 74, a host interface (I/F) 75, and an external interface (I/F) 76, which are connected through a bus 70.

The CPU 71 performs various arithmetic processing. The ROM 72 is a non-volatile storage medium, and stores various programs, such as a print processing program, various values, such as a temperature to be set to the fixing unit 16, and the like. The RAM 73 is a volatile storage medium, and is used by the CPU 71 as a work area or an area for storing various information when the CPU 71 executes various programs. The RAM 73 includes a print data storage portion 73A that stores print data.

The timer 74 measures an elapsed time from the current time or a predetermined reference time, and other time periods, and informs the CPU 71 of them. Also, the timer 74 is used for timing various control signals, such as synchronizing multiple control signals, or providing predetermined time differences between multiple control signals.

The host interface 75 conforms to communication standards, such as wired local area network (LAN) standards, such as the Institute of Electrical and Electronics Engineers (IEEE) 802.3ab, or the Universal Serial Bus (USB) standards, and transmits and receives various data to and from the computer apparatus 100. When the host interface 75 receives print data supplied from the computer apparatus 100, it supplies the print data to the RAM 73 and stores the print data in the print data storage portion 73A, under control of the CPU 71.

The external interface 76 is connected to various portions in the image forming apparatus 1, and transmits and receives various control signals, data obtained by sensors, and other information to and from the various portions. For example, the external interface 76 obtains data indicating the presence or absence of a sheet detected by each of a registration sensor 9 and a discharge sensor 18, the toner density of a toner image detected by the density sensor 27, the temperature detected by each of the heating roller unit temperature sensor 43 and pressure roller temperature sensor 44, and other information.

The external interface 76 is also connected to a printer display 78. The printer display 78 is, for example, a liquid crystal panel disposed near a front end of an upper surface of the printer housing 2 (see FIG. 1) or at another location, and displays various information regarding the image forming apparatus 1 to inform a user of the information, by means of characters, graphics, images, or the like supplied from the CPU 71 through the external interface 76.

The external interface 76 is further connected to a process controller 80. While cooperating with the CPU 71 through the external interface 76, the process controller 80 controls supply of current or voltage for processes, such as sheet conveyance, charging of various portions, image development, transfer of toner images, and fixing of the toner images to the sheet, of the printing process that require relatively large amounts of power or high voltages.

The process controller 80 includes a high voltage controller 81, an exposure controller 82, a motor controller 83, and a fixing temperature controller 84. The high voltage controller 81 appropriately controls voltages applied to various rollers and the like, and includes an image drum (ID) unit voltage controller 87 and a transfer controller 88.

The image drum unit voltage controller 87 performs control to apply appropriate voltages to various rollers, such as charging rollers, of the image drum units 30 (see FIG. 1). The transfer controller 88 performs control to apply voltages appropriate for transfer of the toner images to the primary transfer rollers 24 and secondary transfer roller 14. Thereby, the primary transfer rollers 24 can transfer the toner images from the surfaces of the photosensitive drums 34 (see FIG. 1) onto the intermediate transfer belt 23. The secondary transfer roller 14 can transfer the toner images from the intermediate transfer belt 23 to the sheet P on the conveying path W.

The exposure controller 82 (see FIG. 3) generates data sets for exposure for the different colors on the basis of print data supplied from the CPU 71 through the external interface 76, and sequentially supplies the generated data sets to the LED heads 33 for the different colors. The LED heads 33 can cause the LEDs to emit light as appropriate in accordance with the supplied data sets, thereby sequentially forming electrostatic latent images on the peripheral surfaces of the photosensitive drums 34 (see FIG. 1).

The motor controller 83 controls multiple motors disposed in different units in the image forming apparatus 1 and rotates the motors as appropriate, thereby causing drive forces to be transmitted to the different units. Specifically, the motor controller 83 rotates and stops, for example, the rollers in the image drum units 30 (see FIG. 1), the hopping roller 6, the pair of registration rollers 8, the pair of conveying rollers 12, the pair of conveying rollers 62, the rollers of the fixing unit 16 (see FIG. 2), the drive roller 21 of the intermediate transfer unit 20, and the like. The motor controller 83 also rotates the switch blade 19 to a predetermined angle, or moves the switch blade 19 to a predetermined attitude, thereby switching the conveying route of the sheet P.

The fixing temperature controller 84 controls current supplied to the heater 55 on the basis of the respective temperatures detected by the heating roller unit temperature sensor 43 and pressure roller temperature sensor 44, thereby adjusting the heating roller unit 41 and pressure roller 42 to predetermined temperatures.

<3. Print Processing>

Next, regarding the printing process of the image forming apparatus 1, a printing process in accordance with a common processing procedure, a fundamental principle, and a specific processing procedure in this embodiment will be described.

<3-1. Image Quality Degradation>

The following assumes that as illustrated in FIG. 4, an image (referred to below as the print image 200) in which multiple medical images are arranged vertically and horizontally is printed on a sheet P that is an overhead projector (OHP) film or sheet. For convenience of description, the left-right direction in FIG. 4 is defined as the X direction, the rightward direction in FIG. 4 is defined as the +X direction, the leftward direction in FIG. 4 is defined as the −X direction, the up-down direction in FIG. 4 is defined as the Y direction, the upward direction in FIG. 4 is defined as the +Y direction, the downward direction in FIG. 4 is defined as the −Y direction, the direction perpendicular to the drawing sheet of FIG. 4 is defined as the Z direction, the direction from the back side to the front side of the drawing sheet of FIG. 4 is defined as the +Z direction, and the direction from the front side to the back side of the drawing sheet of FIG. 4 is defined as the −Z direction. The OHP film is made of, for example, polyethylene terephthalate (PET) resin, and is 0.2 mm in thickness.

The sheet P is conveyed along a sheet conveying direction E in the image forming apparatus 1 (see FIG. 1). Specifically, the sheet P has a sheet head PH, which is located on the upper side of FIG. 4, and a sheet tail PT, which is located on the lower side of FIG. 4. The sheet P is conveyed along the conveying path W with the sheet head PH as the leading end and the sheet tail PT as the trailing end. Thus, in the secondary transfer unit 13 (see FIG. 1), the toner images are transferred onto the sheet P sequentially from the sheet head PH side, and in the fixing unit 16, the toner images are fixed to the sheet P sequentially from the sheet head PH side. For convenience of description, hereinafter, the sheet head PH side will be referred to as the downstream side, and the sheet tail PT side will be referred to as the upstream side. Hereinafter, the X direction will also be referred to as the main scanning direction, and the Y direction will also be referred to as the sub-scanning direction.

In the print image 200, multiple image arrangement areas 201 in which medical images are placed are arranged in horizontal rows and vertical columns, i.e., in a matrix, at predetermined intervals. Each image arrangement area 201 has a horizontally long elliptical shape, and consists of an image region 202 and a base region 203. The region of the print image 200 other than the image arrangement areas 201 is a background region 204.

Each image region 202 is a region where a portion of a medical image showing a portion of a human body is placed, and is, for example, a region where an image generated by computed tomography (CT) scan, magnetic resonance imaging (MRI), or the like is placed. In each image region 202, toner is placed in accordance with the shape, shade, or the like of the image. For convenience of drawing, FIG. 4 shows each image region 202 as a semi-elliptical region occupying the upper half of the image arrangement area 201. In this embodiment, a toner layer thickness, which is a thickness of toner (or toner layer) transferred on the sheet P, is represented by taking, as 100%, a thickness of a toner layer formed on the surface of the sheet P when a single-color toner image with a pattern having a density of 100% (i.e., a single-color solid toner image) is transferred onto the surface of the sheet P. The toner layer thickness of 100% is, for example, from 10 to 20 μm. Each image region 202 has a toner layer thickness of, for example, 300%.

Each base region 203 is a base portion of the image arrangement area 201, and is, for example, a region where a portion of the medical image showing a space outside the human body is placed. When the base region 203 is displayed on a screen, it is represented in white. When the base region 203 is printed, no toner is transferred, leaving the OHP film transparent. Thus, each base region 203 has a toner layer thickness of 0%.

The background region 204 tightly surrounds or encloses each image arrangement area 201 with no space therebetween. Thus, the background region 204 blocks the −Y side of each base region 203. To represent that the background region 204 is a portion outside the image arrangement areas 201, the background region 204 is uniformly filled in black. The background region 204 has a toner layer thickness of, for example, 380%.

As such, in the print image 200 printed on the sheet P, the thickness of the toner transferred on the surface of the sheet P (i.e., the toner layer thickness) varies with location. Here, attention is paid to one image arrangement area 201A of the image arrangement areas 201 in FIG. 4. FIGS. 5A, 5B, and 5C respectively illustrate cross sections of the base region 203 of the image arrangement area 201A taken along lines F1-F1, F2-F2, and F3-F3, which cross the base region 203 along the X direction.

As shown in FIGS. 5A to 5C, in the print image 200 transferred on the sheet P, there is a sufficient height difference (i.e., distance in the Z direction) between the base region 203 having a toner layer thickness of 0% and the surface of the background region 204 having a toner layer thickness of 380%.

On the surface of the sheet P on which the toner image of the print image 200 (see FIG. 4) is transferred, the toner of the background region 204 surrounding the image arrangement area 201A forms a space that has a flattened elliptic cylindrical shape having a central axis along the Z direction and that opens in the +Z direction. In the elliptic cylindrical space, while in the image region 202, which occupies about half of the image arrangement area 201A on the sheet head PH side, a sufficient amount of toner is accumulated to form a toner layer having a toner layer thickness of 300%, in the base region 203, which occupies about half of the image arrangement area 201A on the sheet tail PT side, no toner is accumulated, so that the space on the base region 203 is filled with air.

In the cross sections (see FIGS. 5A, 5B, and 5C) taken along lines F1-F1, F2-F2, and F3-F3, the base region 203 has lengths L1, L2, and L3 along the X direction, respectively. Since the image arrangement area 201A is elliptical, the relationship of L1>L2>L3 is satisfied. Specifically, the length (or width) of the base region 203 in the X direction gradually decreases in the −Y direction (or toward the sheet tail PT).

When the print image 200 (see FIG. 4) is printed on the sheet P, in the image forming apparatus 1 (see FIG. 1), the toner image formed on the intermediate transfer belt 23 is transferred onto the sheet P in the secondary transfer unit 13, and then the toner image is fixed to the sheet P in the fixing unit 16 (see FIG. 2). The fixing unit 16 (see FIG. 2) applies heat and pressure to the toner image while conveying the sheet P rearward along the conveying path W and causing the sheet P to pass through the nip portion N sequentially from the sheet head PH side (see FIG. 4).

At this time, in the nip portion N (see FIG. 2), while the uppermost portion of the background region 204 having the largest toner layer thickness raises the fixing belt 51 relative to the pressure roller 42, the fixing belt 51 is pressed against the sheet P and toner, even in portions having relatively small toner layer thickness, due to elastic deformation of the fixing belt 51 and pressure roller 42.

In the fixing unit 16, as the sheet P is conveyed rearward, the air located in the base region 203 of the image arrangement area 201A is pushed upstream by the nip portion N. At this time, in the fixing unit 16, since the fixing belt 51 is made of resin material having flexibility and has no gaps or holes formed therein, almost none of the air leaks through the fixing belt 51. Also, in the fixing unit 16, since the sheet P is an OHP film and has no gaps between fibers like those in paper, the air does not pass through the sheet P. Further, in the image arrangement area 201A, the base region 203 is gradually narrowed in the −Y direction (or toward the sheet tail PT) and finally closed by the background region 204.

Thus, in the fixing unit 16 (see FIG. 2), when the air in the base region 203 is blocked by the background region 204, the air slightly raises the fixing belt 51 upward to form a space to temporarily escape, in the third nip portion N3, which is a gap between the first nip portion N1 and the second nip portion N2.

Then, in the fixing unit 16, when the sheet P is further conveyed and an image arrangement area 201B located on the −Y side (or sheet tail PT side) of and next to the image arrangement area 201A reaches the nip portion N, a space is likely to be formed between the lower surface of the fixing belt 51 and the upper surface of the toner in the image region 202, which has a toner layer thickness smaller than that of the background region 204. Thus, in the fixing unit 16, the air located in the third nip portion N3 flows and escapes upstream (or toward the sheet tail PT) through a space between the lower surface of the fixing belt 51 and the upper surface of the toner in a portion of the image region 202 of the image arrangement area 201B.

Figure 6:
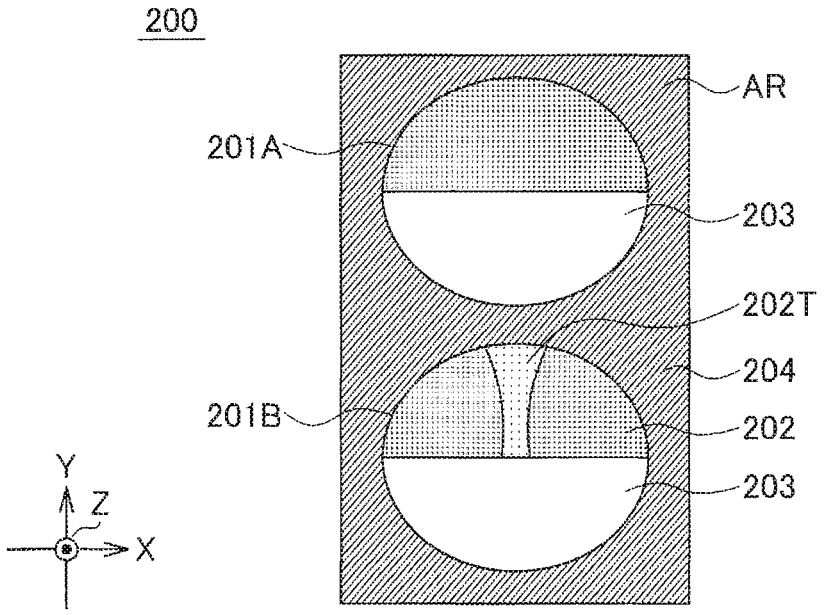
FIG. 6 is a schematic view illustrating degradation in image quality due to overlap of air.

Then, in the fixing unit 16, heat and pressure are applied to the toner in a state where the air escaped from the third nip portion N3 is located on the toner placed in the image region 202 of the image arrangement area 2015, that is, where the toner of the image region 202 and the air are sequentially superimposed on the sheet P. This results in a situation where the toner surface state of the portion of the toner image on the sheet P that was covered by the air is different from that of its surrounding portion that was not covered by the air. Specifically, for example, as shown in FIG. 6, which is an enlarged view of the region AR in FIG. 4, in the fixing unit 16, the image surface state of an air-covered portion 202T of the image region 202 after fixing that was covered by the air is different from that of its surrounding portion, which degrades the image quality. From its appearance, general shape, or the like, the portion with degraded image quality looks as if a raindrop had occurred in the image region 202. Thus, hereinafter, such a portion with degraded image quality will be referred to as a "raindrop mark."

As above, when the image forming apparatus 1 prints the image having the multiple image arrangement areas 201 and the background region 204 surrounding the image arrangement areas 201 on a sheet P having low breathability like an OHP film, or in other similar cases, raindrop marks may occur, degrading the image quality.

<3-2. Process for Preventing Image Quality Degradation>

Thus, the image forming apparatus 1 is configured to, when there is a possibility that air is accumulated in a fixing portion (or the nip portion N) and degrades image quality on the upstream side (specifically, forms a raindrop mark), form a structure for allowing air to escape and preventing the air from accumulating, in order to prevent the image quality degradation (specifically, a raindrop mark).

Figure 7:
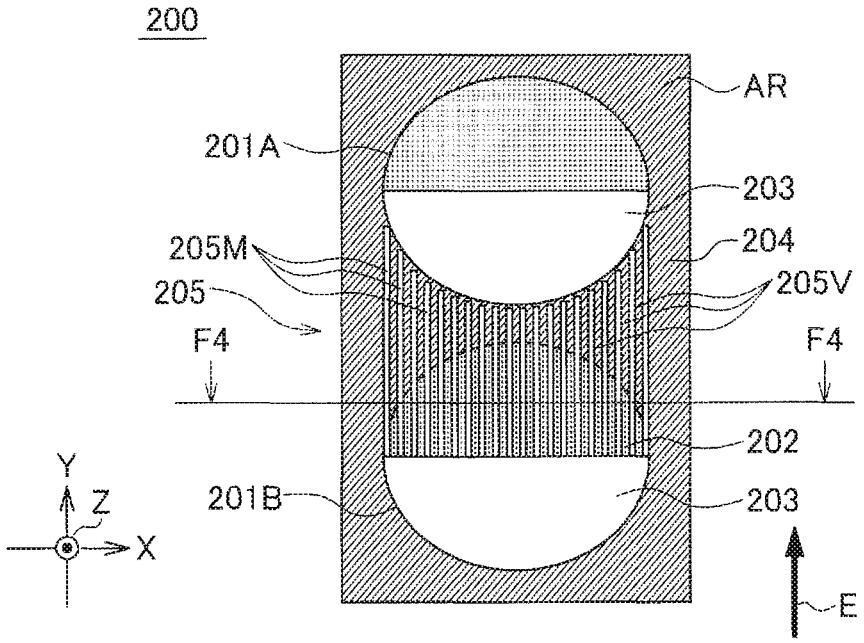
FIG. 7 is a schematic view illustrating a configuration of a groove portion.
Figure 8:
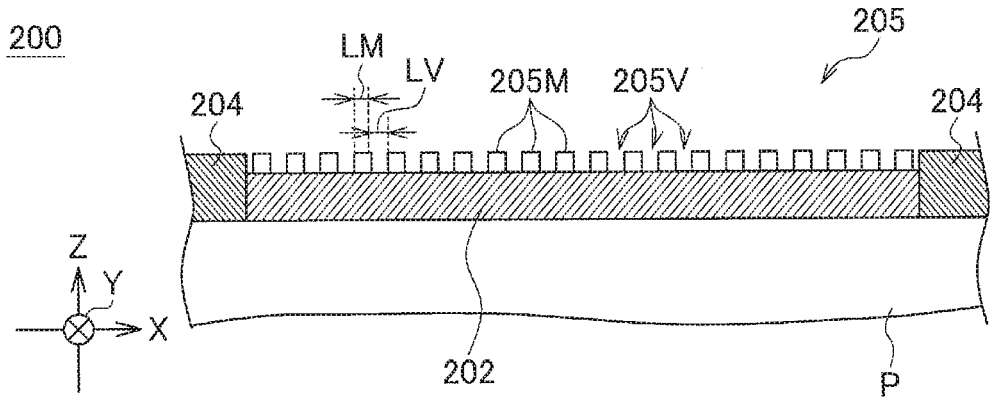
FIG. 8 is a schematic sectional view illustrating the configuration of the groove portion.

Specifically, as illustrated in FIG. 7, which is a plan view, and FIG. 8, which is a sectional view taken along line F4-F4 of FIG. 7, the image forming apparatus 1 provides a groove portion 205 in the print image 200 using clear toner so that the groove portion 205 is superimposed on the background region 204 and image region 202 on the upstream side of the base region 203.

As illustrated in FIG. 7, the groove portion 205 has a groove pattern in which multiple thin linear grooves 205V substantially parallel to the sheet conveying direction E are arranged at predetermined regular intervals in the X direction (or main scanning direction). Specifically, the groove portion 205 includes ridges (or hill-shaped portions) 205M having linear shapes along the Y direction and formed by placing clear toner, and the grooves (or valley-shaped portions) 205V, which have linear shapes along the Y direction and where no clear toner is placed. The ridges 205M and grooves 205V alternate in the X direction.

In the groove portion 205, the length (or line width) LM of each ridge 205M in the X direction is about 0.5 mm, and the length (or groove width) LV of each groove 205V in the X direction is also about 0.5 mm. Thus, in the groove portion 205, linear lines along the Y direction are arranged with a pitch of 1 mm and a duty ratio of 50% in the X direction. Each ridge 205M of the groove portion 205 has a toner layer thickness of 100%.

The image forming apparatus 1 performs an image forming method including placing toner on a sheet P in accordance with image data to form a toner image; and fixing the toner image to the sheet P while conveying the sheet P along a conveying direction. The image forming method further includes determining, as a blocked region, a region of the toner image where no toner is placed and whose upstream side in the conveying direction is blocked by a developer region where the toner is placed; and forming at least one groove extending in the conveying direction in an upstream region of the toner image that is located upstream of the blocked region in the conveying direction and included in the developer region.

In an aspect, the image forming method determines the blocked region by using the image data, and in forming the at least one groove, generates groove image data for forming the at least one groove on the basis of the determination, and places toner on the sheet P in accordance with the groove image data to form the at least one groove in the upstream region.

In an aspect, in forming the at least one groove, the image forming method determines, as the upstream region, a region located upstream of the blocked region in the conveying direction, included in the developer region, and extending to a boundary between the developer region and non-developer region where no toner is placed.

In an aspect, the at least one groove includes multiple linear grooves along the conveying direction.

In an aspect, the image forming method forms the at least one groove by placing transparent toner on the sheet P.

In an aspect, the image forming method forms the at least one groove by placing toner on the sheet P so that the toner forming the at least one groove is farther from the sheet P than the toner image.

In an aspect, the image forming method forms the at least one groove by placing toner on the sheet P so that the toner forming the at least one groove is closer to the sheet P than the toner image.

In an aspect, in determining the blocked region, the image forming method determines, as a non-developer region, a region of the toner image where no toner is placed; and when it is determined that an upstream side of the non-developer region in the conveying direction is blocked by a region where the amount of toner per unit area is greater than or equal to a predetermined threshold value, determines the non-developer region as the blocked region.

In an aspect, in determining the blocked region, the image forming method determines, as a non-developer region, a region of the toner image where no toner is placed; and when it is determined that the non-developer region has an area greater than or equal to a predetermined threshold value and an upstream side of the non-developer region in the conveying direction is blocked by a developer region where the toner is placed, determines the non-developer region as the blocked region.

In an aspect, the image forming method determines whether the sheet P is non-breathable, and forms the at least one groove when it is determined that the sheet P is non-breathable.

For example, the image forming apparatus 1 includes an image forming unit (including the image drum units 30) that places toner on a sheet P in accordance with image data to form a toner image; and the fixing unit 16 that fixes the toner image to the sheet P while the sheet P is conveyed along a conveying direction. The controller 3 determines, as a blocked region, a region of the toner image where no toner is placed and whose upstream side in the conveying direction is blocked by a developer region where the toner is placed; and forms at least one groove extending in the conveying direction in an upstream region of the toner image that is located upstream of the blocked region in the conveying direction and included in the developer region. The controller may be implemented by processing circuitry, which may include a processor that executes a program stored in a memory to perform the functions of the controller or may be hardware circuitry.

The image forming apparatus 1 may perform an image forming method including placing toner on a sheet P in accordance with image data to form a toner image; and fixing the toner image to the sheet P while conveying the sheet P along a conveying direction, and further including determining, as a blocked region, a developer-poor region of the toner image whose upstream side in the conveying direction is blocked by a developer-rich region where the amount of toner per unit area is greater than that of the developer-poor region; and forming at least one groove extending in the conveying direction in an upstream region of the toner image that is located upstream of the blocked region in the conveying direction and included in the developer-rich region.

Next, a printing process by the controller 3 of the image forming apparatus 1 will be specifically described. Upon power-on, the controller 3 (see FIGS. 1 and 3) performs predetermined processing, such as start processing and waiting processing, thereby entering a state where it waits for a print command. In this state, upon receiving print data or the like from the computer apparatus 100 (see FIG. 3), the controller 3 starts a printing process.

Figure 9:
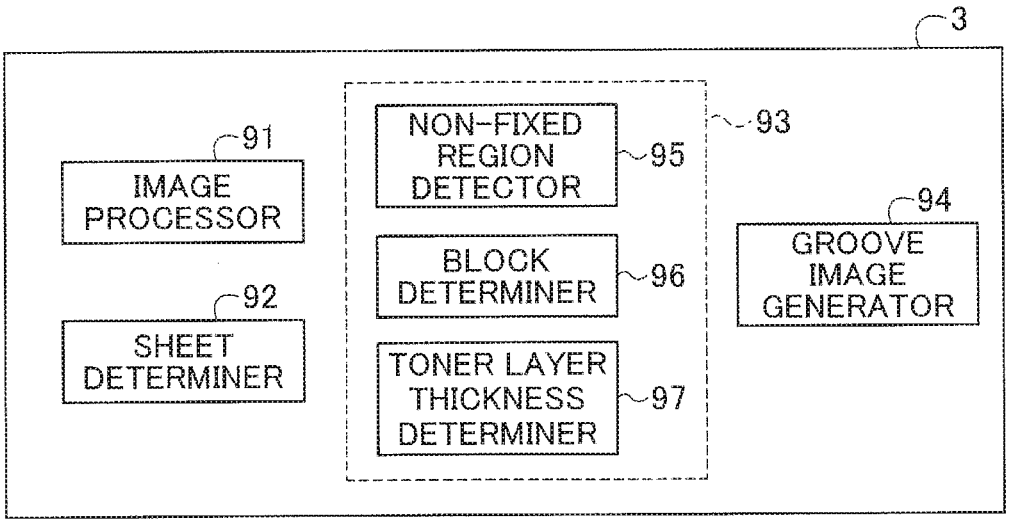
FIG. 9 is a schematic diagram illustrating a functional block configuration of a controller.

At this time, as illustrated in FIG. 9, the controller 3 forms functional blocks including an image processor 91, a sheet determiner 92, a blocked region detector 93, and a groove image generator 94, by the CPU 71 reading and executing a printing program from the ROM 72. Further, the blocked region detector 93 forms therein functional blocks including a non-fixed region detector 95, a block determiner 96, and a toner layer thickness determiner 97.

The image processor 91 performs an analysis process on the received print data, various processes regarding an image included in the print data, and the like. The various processes include a process of converting print data described in a page description language, such as printer command language (PCL), into image data in a raster image format, and a process of decomposing a color image into images of the colors such as cyan of the respective toners, or other processes. The sheet determiner 92 determines whether the type of the sheet P is an OHP sheet.

Figure 10:
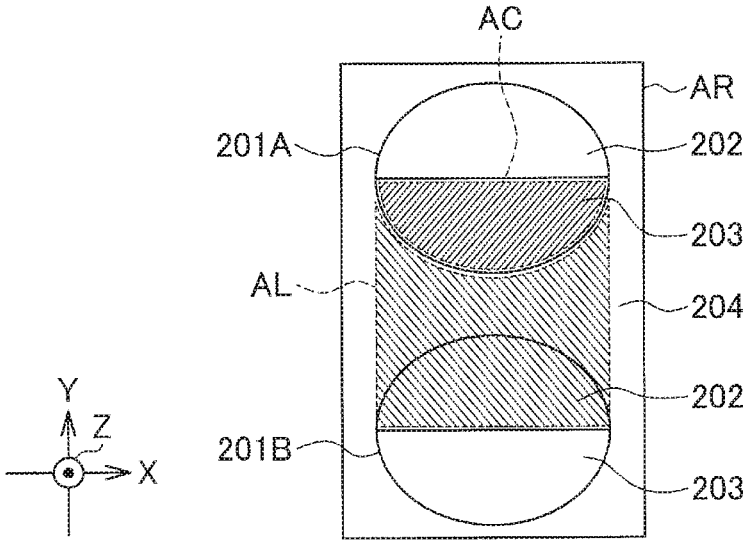
FIG. 10 is a schematic view illustrating a blocked region and an upstream region.

The blocked region detector 93 detects, as a blocked region AC, a region (e.g., a base region 203) where no toner is fixed and whose upstream side is blocked by a region (e.g., the background region 204) where the toner layer thickness is greater than or equal to a predetermined threshold value TH1, as illustrated in FIG. 10. Specifically, the non-fixed region detector 95 detects, from image data to be printed (e.g., image data of the print image 200), a non-fixed region (e.g., base region 203) where the toner layer thickness is 0%, no toner is fixed, and the sheet P is directly exposed. The block determiner 96 determines whether at least the upstream side (or sheet tail PT side) of the detected non-fixed region (e.g., base region 203) is blocked by a portion (e.g., the background region 204) where toner is placed. The toner layer thickness determiner 97 determines whether the toner layer thickness of a region (e.g., the background region 204) that blocks the upstream side of the non-fixed region is greater than or equal to the predetermined threshold value TH1 (e.g., 380%).

The groove image generator 94 generates a groove image (or groove image data) for clear on the image data so that the groove portion 205 is formed with clear toner on the image to be printed (e.g., print image 200) to be superimposed on an area (referred to below as an upstream region AL) located upstream of the blocked region AC, included in the portion (e.g., the background region 204 and image region 202) where toner is placed, and extending to a non-fixed region (e.g., base region 203) located upstream of and next to the blocked region AC.

Figure 11:
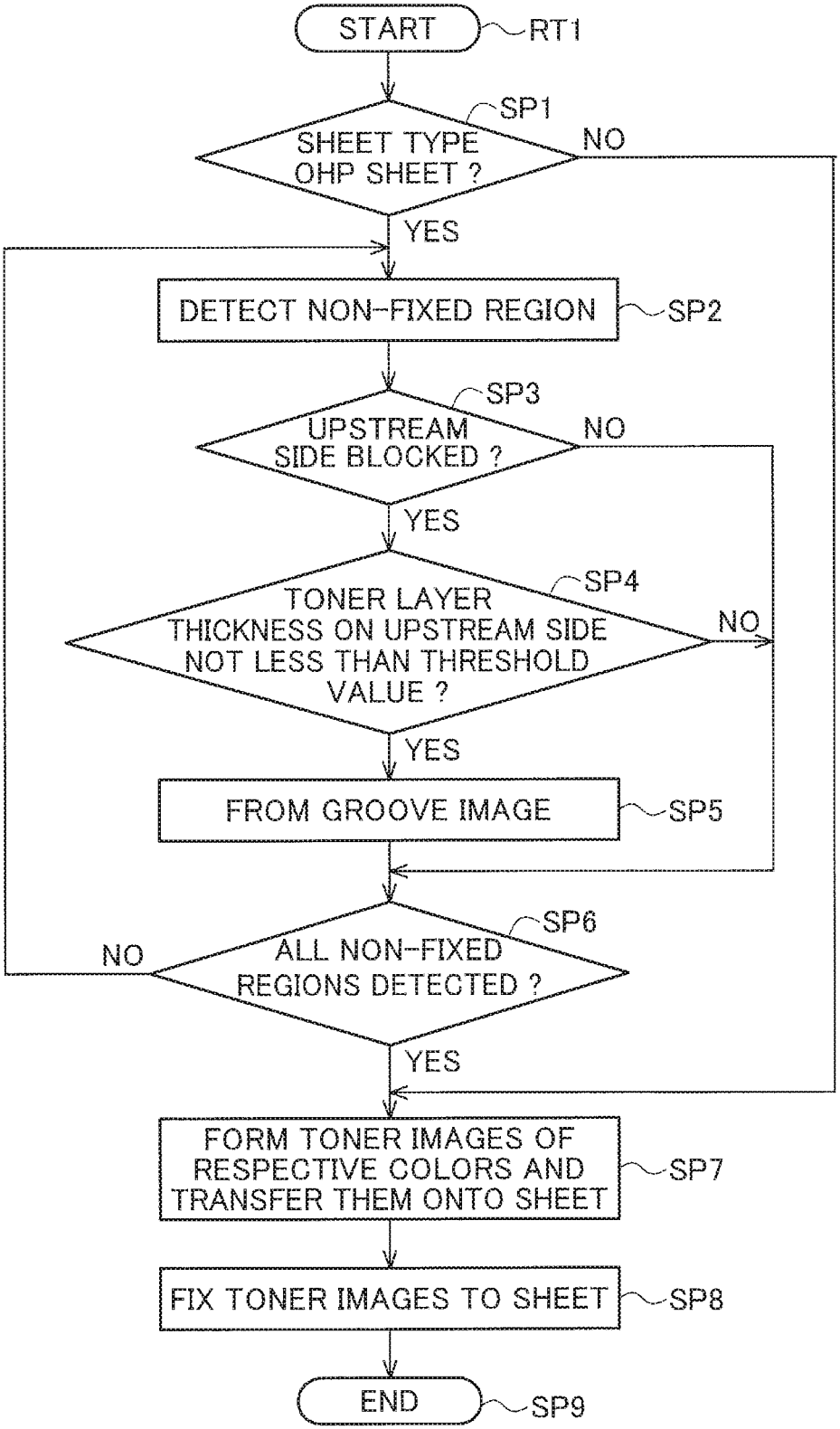
FIG. 11 is a flowchart illustrating a printing process procedure.

After forming these functional blocks, the controller 3 starts a printing process procedure RT1 illustrated in FIG. 11, and proceeds to step SP1. In step SP1, the controller 3 determines whether the type of the sheet P is an OHP sheet, with the sheet determiner 92 (see FIG. 9) serving as a medium determiner. Specifically, the sheet determiner 92 determines whether an OHP sheet is designated as the type of sheet P to be used in the printing process, by analyzing the print data received from the computer apparatus 100 (see FIG. 3).

When the determination in step SP1 is positive, it indicates that, if the image to be printed (e.g., print image 200) includes a blocked region AC, a raindrop mark may be formed on the upstream side of the blocked region AC in the fixing process. In this case, the controller 3 proceeds to the next step SP2.

In step SP2, the controller 3 detects a non-fixed region (e.g., base region 203) from the image to be printed (e.g., print image 200), with the non-fixed region detector 95 (see FIG. 9), and proceeds to the next step SP3. Specifically, the non-fixed region detector 95 sequentially selects, one by one, the lines of the image to be printed (e.g., print image 200) along the main scanning direction (or X direction), and determines the toner layer thickness of each pixel (or dot) of the selected line sequentially along the X direction, thereby sequentially detecting (or finding) non-fixed regions (e.g., base regions 203) where the toner layer thickness is 0%. Then, the non-fixed region detector 95 performs processing, such as comparing the positions, sizes (or lengths), or the like of the detected non-fixed regions between adjacent lines, and groups adjacent non-fixed regions as one non-fixed region.

In step SP3, for the non-fixed region (e.g., base region 203) detected in step SP2, the controller 3 determines whether the upstream side (or sheet tail PT side) of the non-fixed region is blocked, with the block determiner 96 (see FIG. 9).

Specifically, the block determiner 96 detects, for each line along the X direction, the positions, sizes (or lengths), or the like of portions where toner is placed and that are adjacent to the non-fixed region, and determines whether the portions are joined together between adjacent lines, or makes other determinations. Thereby, the block determiner 96 determines whether the upstream side (or sheet tail PT side) of the non-fixed region (e.g., base region 203) is blocked by a portion where toner is placed.

When the determination in step SP3 is positive, the controller 3 proceeds to the next step SP4. In step SP4, the controller 3 determines whether the toner layer thickness of a portion adjacent to the upstream side (or the sheet tail PT side) of the non-fixed region detected in step SP2 is greater than or equal to the threshold value TH1, with the toner layer thickness determiner 97 (see FIG. 9). For example, the controller 3 determines whether the toner layer thickness of a region (e.g., the background region 204) adjacent to the upstream side of the non-fixed region (e.g., base region 203) detected in step SP2 is greater than or equal to the threshold value TH1 (e.g., 380%).

When the determination in step SP4 is positive, it indicates that a region where the toner layer thickness is sufficiently large is located upstream of and adjacent to the non-fixed region (e.g., base region 203) and the non-fixed region is a blocked region AC. This indicates that there is a possibility that when the toner image is fixed in the fixing unit 16, air fails to escape and accumulates, and heat and pressure are applied to the toner image with the air located thereon, degrading the image quality or forming a raindrop mark (see FIG. 6) on the upstream side of the non-fixed region. In this case, the controller 3 proceeds to the next step SP5.

In step SP5, the controller 3 generates an image (referred to below as a groove image) for forming the groove portion 205 (see FIGS. 7 and 8) in a portion on the upstream side of the blocked region AC in image data for clear, with the groove image generator 94 (see FIG. 9), and proceeds to the next step SP6.

Specifically, the groove image generator 94 determines, as an upstream region AL, an area that is located upstream of the blocked region AC, that substantially coincides with the blocked region AC in the main scanning direction (or X direction), and that extends in the sub-scanning direction (or Y direction) from a boundary of the blocked region AC on the upstream side to a boundary of another non-fixed region (e.g., base region 203) located upstream of and next to the blocked region AC. Then, the groove image generator 94 generates a groove image on the upstream region AL. The groove image is configured to form multiple linear ridges having a toner layer thickness of 100%, extending along the sub-scanning direction (or Y direction), and having a line width of 0.5 mm in the main scanning direction (or X direction), and multiple grooves having a groove width of 0.5 mm in the main scanning direction (or X direction), as described above.

On the other hand, when the determination in step SP3 is negative, it indicates that the upstream side of the non-fixed region is not blocked. Also, when the determination in step SP4 is negative, it indicates that the toner layer thickness of the region adjacent to the upstream side of the non-fixed region is not sufficiently large and no air will accumulate during the fixing. These indicate that the non-fixed region is not a blocked region AC and thus there is no need to form a groove portion 205 (or groove image) on the upstream side of the non-fixed region. In these cases, the controller 3 proceeds to the next step SP6.

In step SP6, the controller 3 determines whether all non-fixed regions have been detected from the image to be printed (e.g., print image 200). Specifically, the controller 3 determines whether the search for non-fixed regions has been completed up to the last pixel of the last line. When the determination in step SP6 is negative, the controller 3 returns to step SP2 and repeats the series of processes.

On the other hand, when the determination in step SP6 is positive, it indicates that all non-fixed regions (e.g., the base regions 203) have been detected from the image to be printed (e.g. print image 200) and a groove image has been formed upstream of each non-fixed region determined as a blocked region AC. In this case, the controller 3 proceeds to the next step SP7.

When the determination in step SP1 is negative, it indicates that the sheet. P is plain paper or the like, and if the image to be printed (e.g., print image 200) includes a blocked region AC, gaps between paper fibers of the sheet P allow air to pass therethrough to the back side during the fixing process. This indicates that no raindrop mark is likely to occur during the fixing process and no groove image need be formed. In this case, the controller 3 proceeds to the next step SP7.

In step SP7, the controller 3 generates data sets for exposure for the respective colors including clear with the image processor 91, and sequentially supplies them to the image drum units 30 (see FIG. 1), thereby forming toner images of the respective colors and transferring them onto the intermediate transfer belt 23. At this time, when the image data for clear includes a groove image, the controller 3 forms a toner image including the groove portion 205 with clear toner, and transfers it onto the intermediate transfer belt 23. Further, the controller 3 conveys the sheet P along the conveying path W and transfers the toner images from the intermediate transfer belt 23 to the sheet P with the secondary transfer unit 13, proceeding to the next step SP8.

Thereby, the toner images (e.g., print image 200) formed with the toners of the respective colors such as cyan are transferred onto the sheet P. When a groove image has been generated in step SP5, the groove portion 205 is formed with clear toner on the uppermost layer of the upstream side of the blocked region AC of the image (e.g., print image 200) on the sheet P (see FIGS. 7 and 8).

In step SP8, the controller 3 conveys the sheet P with the toner images transferred thereon to the fixing unit 16, thereby applying heat and pressure to the sheet P in the fixing unit 16 to fix the toner images. At this time, even if the image (e.g., print image 200) includes a blocked region AC (e.g., base region 203), when the blocked region AC reaches the nip portion N in the fixing unit 16, the grooves 205V of the groove portion 205 allow air in the blocked region AC to escape therethrough to the upstream side. This can prevent the air in the blocked region AC (e.g., base region 203) from accumulating in the third nip portion N3 in the fixing unit 16, covering the toner in a region (e.g., the image region 202) located upstream of the blocked region AC, and causing a raindrop mark. After that, the controller 3 proceeds to the next step SP9 and ends the printing process procedure RT1.

<4. Advantages>

In this embodiment, when an image includes a blocked region, a groove image is generated and superimposed on an upstream region located upstream of the blocked region in the image. Thus, when the image forming apparatus 1 transfers the image including the groove image onto a medium, a groove pattern is formed on the upstream region. This allows air in the blocked region to escape through the groove pattern to the upstream side.

With this embodiment, it is possible to provide an image forming method and an image forming apparatus capable of preventing degradation in image quality caused during a fixing process.

Specifically, when performing a printing process on a sheet P that is an OHP sheet, if a non-fixed region (e.g., base region 203) included in the image to be printed (e.g., print image 200) is a blocked region AC, the controller 3 of the image forming apparatus 1 of this embodiment forms a groove portion 205 with clear toner in the upstream region AL located upstream of the blocked region AC so that the groove portion 205 is superimposed on the background region 204 or the like (see FIGS. 7 and 8).

Thus, when the image forming apparatus 1 fixes the image to be printed (e.g., print image 200) to the sheet P, which is an OHP sheet, in the fixing unit 16, the grooves 205V of the groove portion 205 allow air in the blocked region AC to gradually escape therethrough to the upstream side. Thereby, the image forming apparatus 1 can prevent the air in the blocked region AC from accumulating in the nip portion N during the fixing process, covering a toner image being applied with heat and pressure, and degrading the image quality or causing a raindrop mark (see FIG. 6), and fix the image to be printed (e.g., print image 200) to the sheet P with high image quality.

Also, the controller 3 forms the groove portion 205 (see FIG. 7) with clear toner, which is colorless and transparent, instead of colored toner, such as cyan toner. Thus, the image forming apparatus 1 can print the image to be printed on the sheet P in such a manner that the groove portion 205 is unnoticeable and the printed image looks nearly identical to the original image (e.g., print image 200).

The image forming apparatus 1 is configured to form the functional blocks, such as the groove image generator 94 (see FIG. 9), in the controller 3 by executing the printing program or the like, form a groove image for clear with the functional blocks, and form the groove portion 205 with clear toner, without changing the structure of the fixing unit 16 or adding components to the fixing unit 16. Thus, simply by partially changing the printing process procedure of a conventional image forming apparatus, without modifying the fixing unit 16, such as changing the components of the fixing unit 16 or adding components to the fixing unit 16, it is possible to prevent the occurrence of raindrop marks.

Further, the controller 3 provides the groove portion 205 only in the upstream region AL located upstream of the blocked region AC (e.g., base region 203), which is, for example, part of the background region 204 and image region 202, and which is a region where toner is placed, instead of over the entire area of the image to be printed (e.g., print image 200) (see FIG. 7). Thus, the image forming apparatus 1 can allow air in the blocked region AC to escape at least to another non-fixed region (e.g., base region 203) located upstream of and next to the blocked region AC in the fixing process, and prevent a raindrop mark from occurring while minimizing the consumption of clear toner.

Further, only when the toner layer thickness on the upstream side of a non-fixed region is greater than or equal to the threshold value TH1 (e.g., 380%), the controller 3 determines the non-fixed region (e.g., base region 203) as a blocked region AC, which may cause the air accumulation during the fixing process, and forms a groove portion 205 on the upstream side of the blocked region AC. Thus, the image forming apparatus 1 does not unnecessarily form a groove portion 205 for a non-fixed region whose upstream side is adjacent to a portion where the toner layer thickness is less than 380% and that is unlikely to cause the air accumulation during the fixing process, or a non-fixed region that is not a blocked region AC, and can reduce waste of clear toner.

With the above configuration, when performing a printing process on a sheet P that is an OHP sheet, if a non-fixed region (e.g., base region 203) included in the image to be printed (e.g., print image 200) is a blocked region AC, the controller 3 of the image forming apparatus 1 forms and superimposes a groove portion 205 with clear toner on the upstream region AL located upstream of the blocked region AC. Thereby, when performing the fixing process in the fixing unit 16, the image forming apparatus 1 can allow air in the blocked region AC to gradually escape through the grooves 205V of the groove portion 205 to the upstream side, and fix the image to be printed (e.g., print image 200) to the sheet P with high image quality while preventing a raindrop mark from occurring.

<5. Modifications>

In the above embodiment, in step SP5 (see FIG. 11) of the printing process procedure RT1, the groove image generator 94 (see FIG. 9) generates a groove image that forms a groove portion 205 (see FIGS. 7 and 8) including multiple linear grooves 205V along the sub-scanning direction (or Y direction), in a portion located upstream of a blocked region AC. However, this is not mandatory. For example, the grooves 205V may have other various shapes, such as linear shapes along oblique directions between the X and Y directions, or curved shapes.

Further, the grooves 205V may have different widths. For example, the grooves 205V may have widths that are relatively large at a center of the blocked region AC (e.g., base region 203) in the X direction and decrease in the ±X directions from the center. The same applies to the widths of the ridges 205M. Further, the width of each groove 205V need not necessarily be constant and may vary in the Y direction. For example, the width of each groove 205V may increase or decrease in the −Y direction. The same applies to the width of each ridge 205M. It is sufficient that the grooves formed based on the groove image at least have shapes extending in the −Y direction (i.e., upstream or toward the sheet tail PT). This makes it possible to allow air in the blocked region AC (e.g., base region 203) to escape through the grooves to the upstream side during the fixing process.

Further, in the above embodiment, a groove portion 205 (see FIGS. 7 and 8) is formed over the entire area of the upstream region AL, which substantially coincides with the blocked region AC in the X direction, is located upstream of and adjacent to the blocked region AC in the Y direction, and extends in the Y direction to another non-fixed region (e.g., base region 203) located upstream of and next to the blocked region AC. However, this is not mandatory. A groove portion 205 may be formed only in part of the upstream region AL. For example, a groove portion 205 may be formed only in the background region 204 within the upstream region AL, or only in about one third to half of the upstream region AL around its center in the X direction.

For example, when the background region 204 includes a first region extending away from the blocked region AC in the +X direction while extending in the −Y direction from the blocked region AC and a second region extending away from the blocked region AC in the −X direction while extending in the −Y direction from the blocked region AC, the groove portion 205 may be formed to include one or more first grooves formed in and along the first region and one or more second grooves formed in and along the second region. This makes it possible to form the groove portion 205 within the background region 204 outside the image region 202, thereby avoiding degradation in image quality due to formation of the groove portion 205 in the image region 202.

Further, in the above embodiment, when a groove portion 205 (see FIGS. 7 and 8) is formed with clear toner, the ridges 205M have a toner layer thickness of 100%, and the grooves 205V have a toner layer thickness of 0%. However, this is not mandatory. For example, the ridges 205M may have a toner layer thickness of 70%, 80%, or the like. This can reduce or minimize the consumption of clear toner. For example, the grooves 205V may have a toner layer thickness of 10%, 20%, or the like. This can reduce the difference in gloss between the grooves 205V and the ridges 205M on the sheet P after printing, thereby reducing discomfort to a user who sees the printed image.

Further, in the above embodiment, the clear toner is placed above (or the +z side of) the other color toners, i.e., farthest from the sheet P, and forms the groove portion 205 (see FIG. 8). However, this is not mandatory. For example, the clear toner may be placed below the other color toners, i.e., closest to the sheet P. In this case, the other color toners deposited above the clear toner form a concavo-convex shape depending on the groove portion 205 of the clear toner, so that a groove pattern including grooves and ridges appears in the uppermost portion farthest from the sheet P. The clear toner may be placed between the other color toners.

Further, in the above embodiment, the groove portion 205 (see FIGS. 7 and 8) is formed with clear toner, which is colorless and transparent. However, this is not mandatory. For example, the groove portion 205 (see FIGS. 7 and 8) may be formed with a color toner, such as a black (K) toner or yellow (Y) toner, or a combination of color toners. In this case, it is desirable to select the one or more colors to minimize discomfort to a user who sees the printed image, depending on the content of the image to be printed (e.g., print image 200) or other factors.

Further, in the above embodiment, only when it is determined, in step SP1 (see FIG. 11) of the printing process procedure RT1, that the type of the sheet P is an OHP sheet, the processes such as detection of a non-fixed region (e.g., base region) (in step SP2) are performed, and groove portions 205 are formed. However, this is not mandatory. For example, groove portions 205 may be formed on other various types of media, such as gloss paper. It is sufficient that when the sheet P is a medium having a structure that does not allow air in a blocked region AC (e.g., base region 203) to pass therethrough to the back side of the sheet P during the fixing process, or when the sheet P is a non-breathable medium, groove portions 205 be formed.

Further, in the above embodiment, step SP1 (see FIG. 11) of the printing process procedure RT1 determines whether the type of the sheet P is an OHP sheet by analyzing the print data obtained from the computer apparatus 100. However, this is not mandatory. For example, the determination as to whether the type of the sheet P is an OHP sheet may be made on the basis of the type of the sheet P set as a user set value of the image forming apparatus 1, or a detection value or the like obtained from a sensor disposed in the image forming apparatus 1.

Further, in the above embodiment, steps SP2 and SP3 (see FIG. 11) of the printing process procedure RT1 detect a non-fixed region (e.g., base region 203) and determine whether the non-fixed region (e.g., base region 203) is blocked, by selecting each line along the main scanning direction of the image to be printed (e.g., print image 200) one by one and sequentially examining each pixel of the selected line. However, this is not mandatory. For example, the detection of a non-fixed region (e.g., base region 203) and the determination as to whether the non-fixed region is blocked may be performed by using various known processing methods, such as region extraction or region division, in image processing techniques.

Further, in the above embodiment, in step SP2 (see FIG. 11) of the printing process procedure RT1, when the image to be printed (e.g., print image 200) includes a region where the toner layer thickness is 0%, the non-fixed region detector 95 (see FIG. 9) always detects the region as a non-fixed region. However, this is not mandatory. For example, it is possible that, when the image to be printed (e.g., print image 200) includes a region where the toner layer thickness is 0%, the non-fixed region detector 95 detects the region as a non-fixed region only if the region has an area greater than or equal to a predetermined reference area THA, serving as a reference. This can avoid unnecessarily forming a groove portion 205 for a region that has a relatively small area and does not accumulate enough air to cause a raindrop mark during the fixing process and wasting clear toner.

Further, in the above embodiment, in step SP4 (see FIG. 11) of the printing process procedure RT1, the threshold value TH1, which is a reference for determination of the toner layer thickness on the upstream side of the blocked region AC, is 380%. However, this is not mandatory. The threshold value TH1 may be other values, such as 340% or 270%.

Further, in the above embodiment, step SP2 (see FIG. 11) of the printing process procedure RT1 detects a non-fixed region where the toner layer thickness is 0%. However, this is not mandatory. For example, it is also possible to set a relatively low value, such as 20%, as a threshold value TH2 and detect, as a non-fixed region, a region where the toner layer thickness is less than the threshold value TH2.

Further, in the above embodiment, in the printing process procedure RT1 (see FIG. 11), when the toner layer thickness of a portion located upstream of and adjacent to a non-fixed region (e.g., base region 203) where the toner layer thickness is 0% is greater than or equal to the threshold value TH1 (e.g., 380%), a groove portion 205 is formed in the upstream region AL. However, this is not mandatory. For example, when there are a region (referred to below as a developer-poor region) where the toner layer thickness is relatively low and a region (referred to below as a developer-rich region) that is located upstream of and adjacent to the developer-poor region and where the toner layer thickness is relatively high, and the difference in toner layer thickness between the developer-poor region and the developer-rich region is greater than or equal to a predetermined threshold value TH3, the developer-poor region may be determined or regarded as a blocked region AC. Here, the toner layer thickness is the amount of toner (or developer) per unit area, and it can be referred to as the unit-area developer amount. In this case, the developer-poor region is a region where the unit-area developer amount is relatively small, and the developer-rich region is a region where the unit-area developer amount is relatively large.

Further, in the above embodiment, in the printing process procedure RT1 (see FIG. 11), when a non-fixed region (e.g., base region 203) is a blocked region AC, a groove portion 205 is always formed in the upstream region AL located upstream of the blocked region AC. However, this is not mandatory. For example, whether to form a groove portion 205 may be determined depending on whether a predetermined condition is satisfied. For example, it is possible that, when the upstream region AL is part of the background region 204 and formation of a raindrop mark is permissible, no groove portion 205 is formed. In this case, the background region 204 can be detected by various methods. For example, it is possible to allow the user to designate the position or shape of the background region 204. It is also possible that, when a color (e.g., black) designated by a user uniformly occupies a region having an area greater than or equal to a predetermined value, the region is determined or regarded as the background region 204.

Further, in the above embodiment, when there is a possibility that air in a blocked region AC (e.g., base region 203) moves to the third nip portion N3 in the fixing unit 16, moves to a space on toner on the sheet P to cover the toner, and causes a raindrop mark when heat and pressure are applied, a groove portion 205 is formed upstream of the blocked region. However, this is not mandatory. For example, it is also possible that, when there is a possibility that the image quality degrades due to any action of air in a blocked region (e.g., base region 203) during the fixing (e.g., when there is a possibility that air rapidly flows from the third nip portion N3 onto the toner on the sheet P and thereby roughs the surface of the toner), a groove portion 205 is formed upstream of the blocked region.

Further, in the above embodiment, the controller 3 of the image forming apparatus 1 forms the functional blocks, such as the image processor 91 (see FIG. 9), and then executes the printing process procedure RT1 (see FIG. 11), thereby forming a groove image in a region of the image to be printed (e.g., print image 200) where it is needed, and forming a groove portion 205 with toner on the basis of the groove image. However, this is not mandatory. For example, another device, which may be various types of devices, such as the PC controller 101 (see FIG. 3) of the computer apparatus 100 or a controller of a server apparatus (not illustrated), may previously form a groove image in a region of the image to be printed (e.g., print image 200) where it is needed, and transmit the image to be printed including the groove image as print data to the image forming apparatus 1. In this case, for example, the PC controller 101 may execute a predetermined program, form the functional blocks, such as the non-fixed region detector 95 (see FIG. 9), and perform the processes of steps SP1 to SP6 of the printing process procedure RT1 (see FIG. 11). Alternatively, the processes may be shared by different devices. For example, the PC controller 101 of the computer apparatus 100 or the like may perform the processes of steps SP1 to SP4, i.e., detection of an upstream region AL, and the controller 3 of the image forming apparatus 1 may perform the process of step SP5, i.e., formation of a groove image. In these cases, the sheet conveying direction E (see FIG. 4) can be obtained on the basis of the orientation of the sheets P stored in the sheet cassette 4 of the image forming apparatus 1, or the like.

Further, in the above embodiment, the CPU reads and executes the printing program stored in the ROM 72 (see FIG. 3) of the controller 3 of the image forming apparatus 1. However, this is not mandatory. For example, it is possible to download a printing program from a predetermined server apparatus through the host interface 75 and a LAN, and store the printing program in the ROM 72 or the like. Alternatively, for example, it is also possible to read a printing program from a portable storage medium (e.g., USB memory) conforming to the USB standards, or the like through the host interface 75, and store the printing program in the ROM 72 or the like.

Further, in the above embodiment, the image forming apparatus 1 transmits and receives data to and from the computer apparatus 100 through wire communication conforming to the wired LAN or USB standards by the host interface 75. However, this is not mandatory. For example, the image forming apparatus 1 may transmit and receive data to and from the computer apparatus 100 through a wireless LAN conforming to the IEEE 802.11ac standard or the like, or wireless communication conforming to the Bluetooth (trademark) standard or the like.

Further, in the above embodiment, the present invention is applied to the image forming apparatus 1, which is a single function printer (SFP). However, this is not mandatory. For example, the present invention is applicable to a multi-function peripheral/printer (MFP) having an image scanner function, a communication function, and the like in addition to the printer function and also capable of operating as a copier and a facsimile machine. The present invention is also applicable to various apparatuses, such as facsimile machines or copiers, that have an electrophotographic printing function and perform a fixing process during printing.

Further, the present invention is not limited to any of the above embodiment and modifications. The present invention also covers all possible combinations or subsets of features of the above embodiment and modifications. The present invention can be practiced in various other aspects without departing from the inventive scope.

Further, in the above embodiment, the image forming apparatus 1 as an image forming apparatus is constituted by the blocked region detector 93 as a blocked region detector and the groove image generator 94 as a groove image generator. However, this is not mandatory. The blocked region detector and groove image generator constituting the image forming apparatus may have other configurations.

The present invention can be used for a fixing unit of an image forming apparatus that performs a printing process by electrophotography, for example.

The present disclosure includes the following aspects:

1. An image forming method comprising:

detecting, by a blocked region detector, a blocked region from an image to be formed by fixing developer to a medium conveyed along a conveying direction, the blocked region being a non-fixed region where the developer is not fixed and being a region at least whose upstream side in the conveying direction is blocked by a fixed region where the developer is fixed; and generating, by a groove image generator, a groove image in an upstream region that is located upstream of the blocked region and is at least part of the fixed region, the groove image forming a groove pattern having at least one groove extending in the conveying direction when the groove image is formed with developer.

2. The image forming method of aspect 1, wherein the generating comprises determining, as the upstream region, an area included in the fixed region, located upstream of the blocked region, and extending to a boundary between the fixed region and another non-fixed region located upstream of and next to the blocked region.

3. The image forming method of aspect 1, wherein the at least one groove includes a plurality of linear grooves along the conveying direction.

4. The image forming method of aspect 1, wherein the generating comprises forming the groove image with transparent developer.

5. The image forming method of aspect 1, wherein the generating generates the groove image so that when the image and the groove image are formed on the medium with developer, the developer forming the groove image is farther from the medium than the developer forming the image.

6. The image forming method of aspect 1, wherein the generating generates the groove image so that when the image and the groove image are formed on the medium with developer, the developer forming the groove image is closer to the medium than the developer forming the image.

7. The image forming method of aspect 1, wherein the generating comprises determining, as the upstream region, an area that is included in the fixed region, that is located upstream of the blocked region, and where an amount of developer per unit area is greater than or equal to a predetermined threshold value.

8. The image forming method of aspect 1, wherein the detecting comprises:

detecting a non-fixed region where the developer is not fixed; and when the non-fixed region has an area greater than or equal to a predetermined threshold value, and at least an upstream side of the non-fixed region in the conveying direction is blocked by a fixed region where the developer is fixed, detecting the non-fixed region as the blocked region.

9. The image forming method of aspect 1, further comprising determining, by a medium determiner, whether the medium is non-breathable, wherein the detecting detects the blocked region when the determining determines that the medium is non-breathable.

10. An image forming apparatus comprising:

a blocked region detector that detects a blocked region from an image to be formed by fixing developer to a medium conveyed along a conveying direction, the blocked region being a non-fixed region where the developer is not fixed and being a region at least whose upstream side in the conveying direction is blocked by a fixed region where the developer is fixed; and a groove image generator that generates a groove image in an upstream region that is located upstream of the blocked region and that is at least part of the fixed region, the groove image forming a groove pattern having at least one groove extending in the conveying direction when the groove image is formed with developer.

11. An image forming method comprising:

detecting, by a blocked region detector, a blocked region from an image to be formed by fixing developer to a medium conveyed along a conveying direction, the blocked region being a developer-poor region where an amount of developer per unit area is relatively small or the developer is not placed, and being a region at least whose upstream side in the conveying direction is blocked by a developer-rich region where an amount of developer per unit area is greater than that of the developer-poor region; and generating, by a groove image generator, a groove image in an upstream region that is located upstream of the blocked region and that is at least part of the developer-rich region, the groove image forming a groove pattern having at least one groove extending in the conveying direction when the groove image is formed with developer.

What is claimed is:

1. An image forming method comprising:

placing developer on a medium in accordance with image data to form a developer image; and fixing the developer image to the medium while conveying the medium along a conveying direction, wherein the image forming method further comprises:

determining, as a blocked region, a region of the developer image where no developer is placed and whose upstream side in the conveying direction is blocked by a developer region where the developer is placed; and forming at least one groove extending in the conveying direction in an upstream region of the developer image that is located upstream of the blocked region in the conveying direction and included in the developer region.

2. The image forming method of claim 1, wherein the determining determines the blocked region by using the image data; and the forming comprises:

generating groove image data for forming the at least one groove on a basis of the determination; and placing developer on the medium in accordance with the groove image data to form the at least one groove in the upstream region.

3. The image forming method of claim 1, wherein the forming comprises determining, as the upstream region, a region located upstream of the blocked region in the conveying direction, included in the developer region, and extending to a boundary between the developer region and a non-developer region where no developer is placed.

4. The image forming method of claim 1, wherein the at least one groove includes a plurality of linear grooves along the conveying direction.

5. The image forming method of claim 1, wherein the forming forms the at least one groove by placing transparent developer on the medium.

6. The image forming method of claim 1, wherein the forming forms the at least one groove by placing developer on the medium so that the developer forming the at least one groove is farther from the medium than the developer image.

7. The image forming method of claim 1, wherein the forming forms the at least one groove by placing developer on the medium so that the developer forming the at least one groove is closer to the medium than the developer image.

8. The image forming method of claim 1, wherein the determining comprises:

determining, as a non-developer region, a region of the developer image where no developer is placed; and when it is determined that an upstream side of the non-developer region in the conveying direction is blocked by a region where an amount of developer per unit area is greater than or equal to a predetermined threshold value, determining the non-developer region as the blocked region.

9. The image forming method of claim 1, wherein the determining comprises:

determining, as a non-developer region, a region of the developer image where no developer is placed; and when it is determined that the non-developer region has an area greater than or equal to a predetermined threshold value and an upstream side of the non-developer region in the conveying direction is blocked by a developer region where the developer is placed, determining the non-developer region as the blocked region.

10. The image forming method of claim 1, further comprising determining whether the medium is non-breathable, wherein the forming forms the at least one groove when it is determined that the medium is non-breathable.

11. An image forming apparatus comprising:

an image forming unit that places developer on a medium in accordance with image data to form a developer image; and a fixing unit that fixes the developer image to the medium while the medium is conveyed along a conveying direction, wherein the image forming apparatus further comprises a controller that determines, as a blocked region, a region of the developer image where no developer is placed and whose upstream side in the conveying direction is blocked by a developer region where the developer is placed; and forms at least one groove extending in the conveying direction in an upstream region of the developer image that is located upstream of the blocked region in the conveying direction and included in the developer region.

12. An image forming method comprising:

placing developer on a medium in accordance with image data to form a developer image; and fixing the developer image to the medium while conveying the medium along a conveying direction, wherein the image forming method further comprises:

determining, as a blocked region, a developer-poor region of the developer image whose upstream side in the conveying direction is blocked by a developer-rich region where an amount of developer per unit area is greater than that of the developer-poor region; and forming at least one groove extending in the conveying direction in an upstream region of the developer image that is located upstream of the blocked region in the conveying direction and included in the developer-rich region.

* * * * *